US006171446B1

(12) United States Patent
Diaz-Kotti

(10) Patent No.: US 6,171,446 B1
(45) Date of Patent: Jan. 9, 2001

(54) PRESS FELT WITH GROOVED FIBERS HAVING IMPROVED DEWATERING CHARACTERISTICS

(75) Inventor: Michelle Diaz-Kotti, Columbia, SC (US)

(73) Assignee: Shakespeare Company, Columbia, SC (US)

( * ) Notice: Under 35 U.S.C. 154(b), the term of this patent shall be extended for 0 days.

(21) Appl. No.: 09/174,988

(22) Filed: Oct. 19, 1998

(51) Int. Cl.[7] ..... D21F 7/08

(52) U.S. Cl. ..... 162/358.2; 162/900; 442/337; 442/402

(58) Field of Search ..... 162/358.2, 900, 162/903, 205; 139/383 A; 442/337, 402

(56) References Cited

U.S. PATENT DOCUMENTS

| | | | | |
|---|---|---|---|---|
| 3,158,984 | * | 12/1964 | Butler | 162/903 |
| 4,162,190 | * | 7/1979 | Ashworth | 162/900 |
| 4,427,734 | * | 1/1984 | Johnson | 162/900 |
| 4,759,976 | * | 7/1988 | Dutt | 162/903 |
| 4,943,476 | * | 7/1990 | Sokaris | 162/900 |
| 5,089,324 | | 2/1992 | Jackson | 428/234 |
| 5,368,696 | | 11/1994 | Cunnane, III et al. | 162/358.2 |
| 5,449,548 | * | 9/1995 | Bowen, Jr. | 162/902 |
| 5,651,394 | | 7/1997 | Marchand | 139/383 A |
| 5,998,310 | * | 12/1999 | Bowen, Jr. | 162/902 |

FOREIGN PATENT DOCUMENTS

| | | | | |
|---|---|---|---|---|
| 790861 | * | 9/1980 | (FI) | 162/358.2 |
| WO 90/12130 | | 10/1990 | (WO) | D01D/5/253 |

OTHER PUBLICATIONS

Paper Machine Clothing, Sabit Adanur, Ph.d., "Pressing" 1997, pp. 24 and 153–171.

* cited by examiner

*Primary Examiner*—Karen M. Hastings
(74) *Attorney, Agent, or Firm*—Renner, Kenner, Greive, Bobak, Taylor & Weber

(57) ABSTRACT

A press felt for use in the press section of a papermaking machine includes a base fabric and at least one layer of an assembly of fibers, preferably forming a carded web or batt, the assembly of fibers containing a plurality of fibers having a deep grooved configuration. The deep-grooved fibers of the press felt provide improved dewatering properties to the press felt as compared to conventional round monofilaments of the same denier currently employed as the batt in press felts used in the press sections of papermaking machines. A method for at least partially dewatering a sheet of paper fibers within the press section of a papermaking machine includes positioning the sheet of paper fibers on the press felt described herein, transporting the sheet of paper fibers through the press section, and pressing the sheet to at least partially remove the water therefrom.

29 Claims, 3 Drawing Sheets

PRESS FELT WITH GROOVED FIBERS HAVING IMPROVED DEWATERING CHARACTERISTICS

TECHNICAL FIELD

The present invention generally relates to press felts used in the papermaking process and, more specifically, in the press section of papermaking machinery. More particularly, the present invention relates to press felts comprising a base fabric and one or more layers of preferably carded fibers needle punched thereto, wherein the preferably carded assembly of fibers includes deep-grooved fibers, preferably made from nylon and having vastly improved dewatering properties compared to conventional round fibers currently employed as the batt in the press section of papermaking machines.

BACKGROUND OF THE INVENTION

The processes involved in papermaking have not changed appreciably in many years. In essence, the process of papermaking includes the steps of forming the paper fibers into a matted sheet and commencing to dewater the sheet, pressing the matted sheet through rollers to continue the dewatering process and to give the consolidated sheet its desired texture, and further drying the sheet as necessary to remove any remaining excess water from the sheet. Consequently, a papermaking machine generally includes three pertinent sections: the forming section, the press section and the dryer section.

The procedure of papermaking begins in the forming section with the preparation of a pulp slurry which is approximately 99 percent water and about 1 percent fiber. The pulp slurry is initially carried through the forming section of the papermaking machine on a forming fabric, not unlike a porous conveyor belt, where the pulp slurry is formed into a sheet. In the forming section, some water is removed, and the sheet is formed and transported to the press section of the papermaking machine where the process of removing the water from the sheet, begun in the forming section, is continued.

In the press section of a papermaking machine, the wet, matted sheet of paper fibers is transported on one or more press fabrics and is passed through at least one set of two rollers (and oftentimes a series of rollers) along with the press fabrics such that, in the press nip, at least some of the remaining water is squeezed out of the sheet and is absorbed through the permeable press fabric. As compression is increased between the rollers, water removal is likewise increased. The function of pressing also consolidates the sheet and provides texture to the surface of the sheet.

Although water content of the sheet is somewhat related to the type of papermaking machine employed and the sheet grade, typical consistency of the sheet of paper fibers as it enters the press section is about 20 percent fiber and about 80 percent water and at the end of the section is about 40 percent fiber and about 60 percent water. It will be appreciated, however, that the amount of water that the press fabric can absorb or carry away from the matted sheet is affected by the air and water permeability of the felt and the void volume of the felt, that being the volume that is not occupied by fibers or yarns. To that end, an important characteristic of press felts during operation is the ability of the felt to maintain void volume under load. Other significant press felt or fabric properties include resistance to abrasion, resistance to compaction, heat and chemical resistance as well as strength, permeability and caliper retention.

Within the press section, the sheet is supported and transported via one or more fabrics referred to as "press fabrics" or "press felts", which terms are used interchangeably in the industry. Therefore, unless otherwise specified, for purposes of this invention, the terms "press fabrics" or "press felts" as used herein shall refer to those fabrics used in the press section of a papermaking machine to support and transport the formed sheet of paper fibers to the dryer section of the machine where even more water may be removed.

Today, a press felt generally comprises a base fabric (e.g., a woven or non-woven cloth) having a staple fiber batt needle punched to it. In many press felts, multiple layers of batt fibers are needle punched to the paper side of the base cloth. In other embodiments, layers of batt fibers are needle punched onto each side of the base cloth. As yet another alternative, it is believed that some future commercial press felts may use no batt whatsoever, although most press felts can readily be distinguished from forming fabrics or dryer fabrics due to the presence of the layers of batt fibers. Likewise, it is possible that future press felts may contain no base fabric, these press felts simply comprising layers of batt fibers.

Currently, the base fabric of most press felts are made of 100 percent synthetics, primarily nylon polymers, although polyester and other materials have been used. It will be appreciated that the term "base fabric" refers to the underlying substrate of the press felt and includes scrim and composite structures as well as those woven and non-woven fabrics well known in the art as being suitable for use in press felts for papermaking machinery. Base fabrics are usually woven or otherwise constructed with cabled monofilaments, plied multifilaments, spun yarns or single monofilaments. They may be used in a single layer or multilayer mesh, and can be woven as endless belts or woven flat and joined with seams. The weave of the base fabric is often engineered to manipulate pressure uniformity, flow resistance, void volume and compression properties. These base fabrics may generally be classified as conventional (endless) designs, stratified (laminated) designs, and seam fabrics, and the monofilaments or fibers used therein are typically round in cross-section, although some patents have suggested using flat monofilaments, such as in Jackson U.S. Pat. No. 5,089,324, or oval monofilaments, such as in Marchand U.S. Pat. No. 5,651,394. Cunnane, III et al. U.S. Pat. No. 5,368,696 has also disclosed the use of hollow monofilaments as the fibers used in the base fabric. Alternatively, the base fabric may be a scrim, e.g., an extruded netting, or a composite structure, e.g., an extruded spun-bonded sheet, both of these types of substrates falling within the scope of the claimed invention.

The batt is also typically made from nylon fibers or other similar synthetic materials, which fibers are conventionally round in cross section. It will be appreciated that, for the purposes of the present invention, the term "batt" refers to essentially any kind of assembly or web of fibers other than the base fabric which is suitable for use in press felts, and is not necessarily limited to conventional batting. The fibers usually are carded into a uniform web to form the batt before being needle punched onto the base fabric, generally in a series of layers. Moreover, the batt fibers are often needle punched into the base fabric with the fibers oriented in the cross machine direction or in the machine direction, although alternative methods for needle punching now exist. The needling process can be engineered to affect the density, surface properties and permeability of the press fabric.

Upon review of the prior art with respect to press felts, it will be appreciated that the existing patent literature has generally focused on improving the base fabric of the press felts of papermaking machine in attempting to provide improved dewatering characteristics to the press felts. Very little, if any, literature has focused on or suggested improving the batt or the fibers thereof. In fact, most of the literature suggests doing away with the batt entirely, rather than seeking to improve its dewatering characteristics.

However, in the papermaking industry, improving the dewatering properties of the press felt is believed to be most desirable, regardless of which component of the press felt provides that improvement. Water removal costs far less in the press section than in the dryer section of a papermaking machine. Thus, the value of efficient press felt performance cannot be overemphasized. By improving the dewatering properties of a press felt only one percent, that is to say, for example, increasing the sheet dryness after pressing from 40 percent to 41 percent with a complementary decrease in the water content from 60 percent to 59 percent, a corresponding energy savings of about four percent is provided. Thus, less steam may, in turn, be used in the dryer section of the papermaking machine and/or the machine can run faster, if desired, resulting in increased production.

Using current technology, the round fibers used in the batt in current press felts permit some wicking from capillary action which is formed from the fiber to fiber voids. It will be appreciated that "wicking" is the ability, typically through capillary action, to carry or otherwise transport water or similar fluids from a previously saturated (i.e., wet) area of the press felt to a previously unsaturated (i.e., dry) area in order to provide the press felt with the ability to absorb or, more appropriately, to transport more water away from the sheet of paper fibers. Thus, by providing batt fibers having greater wicking action than the conventional fibers, it is believed that the press felts will have a greater ability to absorb water or transport water away from the sheet of paper fibers, resulting in increased dewatering performance. In turn, the more water that can be absorbed or taken away from the matted sheet of paper fibers, the greater the energy savings to the paper maker.

Thus, the need continues to exist for press felts having improved dewatering properties compared to conventional or currently employed press felts. Heretofore, the art with respect to press felts has not provided a way to improve these properties in the batt component of the press felts used in the press section of papermaking machines.

SUMMARY OF THE INVENTION

In view of the foregoing, an object of the present invention is to provide a press felt having improved dewatering properties.

It is another object of the present invention to provide a press felt, as above, wherein the press felt contains a base fabric with one or more layers of batt fibers needle punched to the base fabric.

It is still another object of the present invention to provide a press felt, as above, wherein the fibers of the present invention provide greater dewatering properties as compared to conventional round fibers employed in the batt of press felts of the prior art.

It is yet another object of the present invention to provide a press felt, as above, wherein the fibers of the present invention have greater wicking and water removal characteristics compared to conventional fibers currently employed in the batt of press felts.

It is a further object of the present invention is to provide a press felt, as above, wherein the press felt provides significant energy savings in the overall operation of the papermaking machine.

It is still a further object of the present invention to provide a method for at least partially dewatering matted sheets of paper fibers in the press section of a papermaking machine.

At least one or more of the foregoing objects of the invention, as well as the advantages thereof over existing and prior art forms relating to press felts, which will be apparent in view of the following detailed specification, are accomplished by means hereinafter described and claimed.

In general, a press fabric suitable for use in transporting a sheet of paper fibers through the press section of a papermaking machine includes a base fabric and at least one layer of an assembly of fibers securely attached to the base fabric. In accordance with the present invention as set forth hereinbelow, the assembly of fibers, i.e., batt, includes a plurality of fibers having a deep grooved configuration.

Further aspects of the invention may be provided in a method for at least partially dewatering a sheet of paper fibers within the press section of a papermaking machine comprising the steps of positioning the sheet of paper fibers on a press felt including a base fabric and at least one layer of an assembly of fibers securely attached to the base fabric, the assembly of fibers including a plurality of fibers having a deep grooved configuration; transporting the sheet through the press section; and pressing the sheet to remove water from the sheet.

BRIEF DESCRIPTION OF THE DRAWINGS

The preferred press felts of the present invention incorporating the concepts of the present invention are illustrated by way of example in the accompanying drawings without attempting to show all of the various forms and modifications in which the invention might be embodied, the invention being measured by the appended claims and not by the details of the description.

PREFERRED EMBODIMENT FOR CARRYING OUT THE INVENTION

Figure 1:
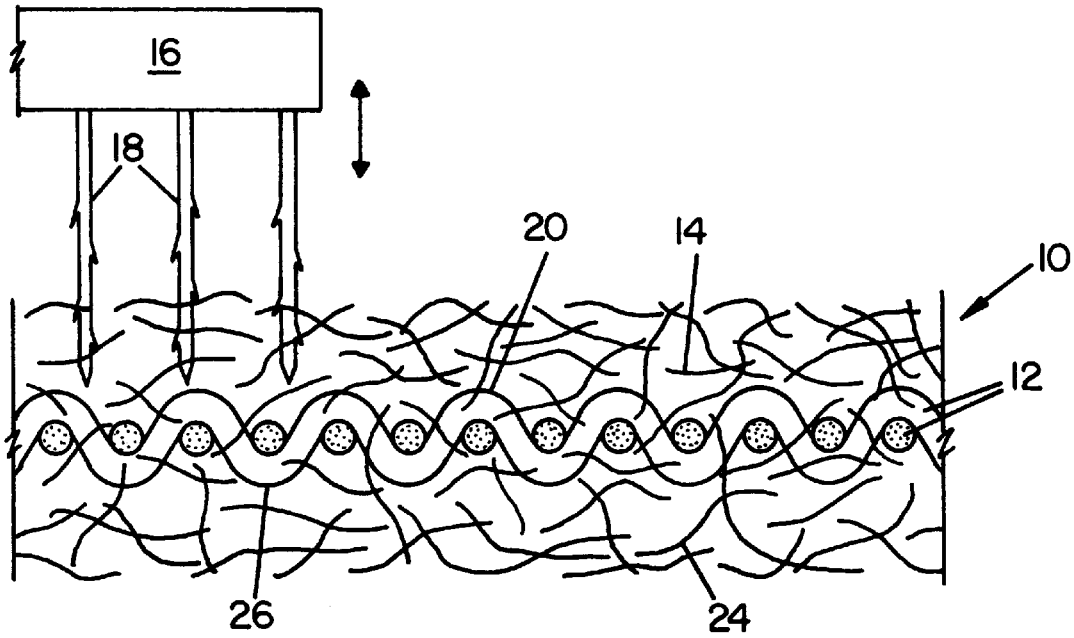
FIG. 1 is a schematic, cross-sectional view of a press felt embodying the concepts of the present invention showing an assembly of batt fibers being needle punched to the base fabric.

A cross-sectional view of one schematically representative form of a press felt or fabric suitable for transporting a sheet of paper fibers through the press section of a papermaking machine and made in accordance with the concepts of the present invention is indicated generally by the numeral 10 in FIG. 1 of the accompanying drawings. The representative form of press felt 10 is shown schematically in cross section in FIG. 1 inasmuch as various forms of press felts, such as batt-on-base felts, baseless felts, batt-on-mesh felts, felts with no-crimp base fabric, composite fabrics, and laminated (stratified) press felts, can be made as commonly known in the art.

Generally, such press fabrics include a base fabric 12 and one or more layers of an assembly of fibers, such as batt 14, securely attached to the base fabric 12 as by needle punching using a needle punching apparatus such as shown schematically at 16, the apparatus 16 having needles 18 for punching the assembly of fibers 14 into the base fabric 12. Preferably and with reference to both FIGS. 1 and 4, where only one layer of fibers 14 is employed, it is needle punched into the side 20 of the base fabric 12 facing the sheet of paper fiber 22, i.e., the paper side of the base fabric, and is, therefore, disposed generally between the base fabric 12 and the sheet of paper fibers 22. When a second layer of batt fibers is employed such as shown as 24 in FIG. 1, it may be needle punched into the other side 26 of the base fabric facing or contacting the roller(s) 28 of the papermaking machine, i.e., the machine side of the base fabric, or may be needle punched through the paper side of the base fabric to the machine side. Various methods of application (e.g., needle punching) of the assembly of fibers 14 to the base fabric 12 are known in the art and any conventional method which sufficiently and securely attaches the assembly of fibers 14 to the base fabric 12 will be suitable for the present invention. Usually, multiple layers of fibers 14 are needle punched into the base fabric 12.

The base fabric 12 is preferably woven (except for no-crimp base fabrics) or formed as a composite and can be made from any of a number of methods known in the art. For example, the fabric may be a single layer or multilayer mesh, and can be woven as a endless belt or woven flat and joined later. The base fabric 12 can be woven in a number of alternative manners to manipulate and otherwise provide particular characteristics and properties to the base fabric. For instance, the fabric can be stratified or laminated with additional fabrics on its surface to create additional layers, or one or more layers of fabric can be employed.

The base fabric 12 of the present invention is preferably made of 100 percent synthetics, although wool may still be employed in older machines. Preferably, polyamide (nylon) polymers are utilized, but the base fabric may also be constructed of polyester, polyphenylene sulfide, or other similar materials. It will be appreciated, however, that nylon has greater resistance to compaction in the press nip compared to polyester, and is more abrasion resistant, tougher, and needles with less breakage compared to polyester.

The base fabric 12 may be constructed with cabled monofilaments, plied multifilaments, spun yarns, and/or single monofilaments. Each type of fiber has properties that influence operational characteristics of the press felt 12 and may be chosen based upon the particular characteristic desired of the base fabric. For example, multifilaments are more durable and have higher elongation than monofilaments, but are also more compressible and less resistant to chemical attack.

The improvement of the press felt 10 over prior art press felts resides substantially in the assembly of fibers 14 employed as the batt of the present invention. It will be appreciated that the term "batt" as used herein refers not only of a soft, bulky bundle of fibers forming a layer on the surface of the base fabric, but also to any other type of assembly of fibers, be it woven or nonwoven, carded or not carded, suitable for use in the press section of a papermaking machine. More particularly, the present invention focuses on the unique construction of at least some of the fibers employed within the assembly of fibers comprising the batt. These fibers allow for improved wicking through capillary action produced from within the fibers as well as from fiber to fiber capillaries. Thus, the fibers provide the press felts 10 of the present invention with improved dewatering properties as compared to previously employed press felts which utilized round fibers or monofilaments.

The batt fibers 14 of the press felt 10 contains a plurality of fibers, each preferably cut to a length of from about 1 inch to about 6 inches, and more preferably, from about 3.0 inches to about 4 inches. The fibers forming the batt preferably range from about 3 denier to about 50 denier, with about 15 to about 25 denier being most preferred.

At least some of the fibers employed in the assembly of fibers forming the batt for the press felts of the present invention are unique from other conventionally round fibers utilized as the batt in prior art press felts in that they have a deep grooved configuration. By the term "deep grooved" it is meant that each fiber has a plurality of open channels or grooves along the longitudinal axis of the fiber. Preferably, these channels or grooves are configured such that the width of the groove at any depth in not greater than the width of the groove at the mouth thereof. Furthermore, these channels or grooves provide particular characteristics to the fiber that can serve as ducts to move water spontaneously, and provide larger surface areas for a given denier per fiber.

Figure 2:
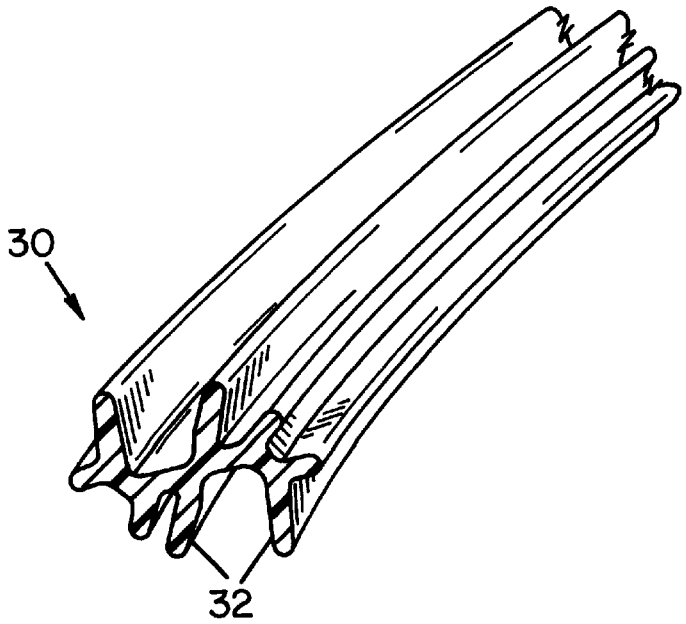
FIG. 2 is an enlarged, cross-sectional view of a fiber employed in the assembly of fibers comprising the batt of the press felt of FIG. 1, the fiber having a deep grooved configuration in accordance with the concepts of the present invention.

As shown in FIG. 2, each deep-grooved fiber could, alternatively, be characterized as multi-lobal in cross-section. Preferably, each of these uniquely configured fibers has at least five lobes, and more preferably, at least eight lobes. Again, however, each lobe is configured such that the groove or space between two lobes located in proximity to each other has a width at any depth which is less than the width at the outermost points of the two proximate lobes.

Figure 3:
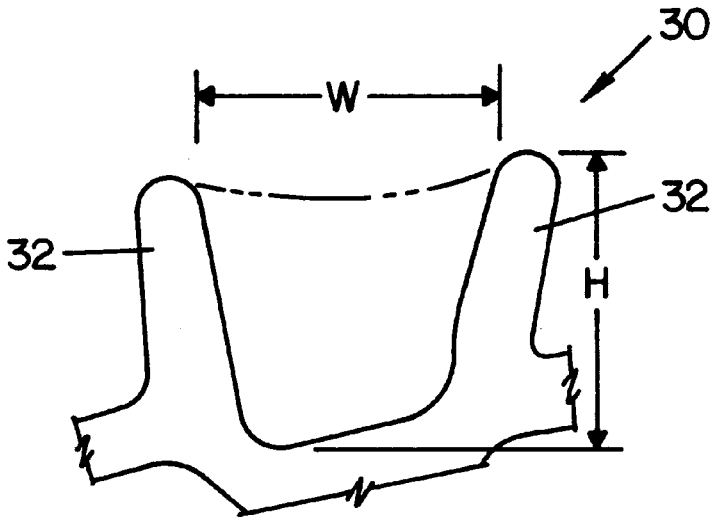
FIG. 3 is an enlarged, sectional view of a portion of the fiber in FIG. 2.
Figure 5:
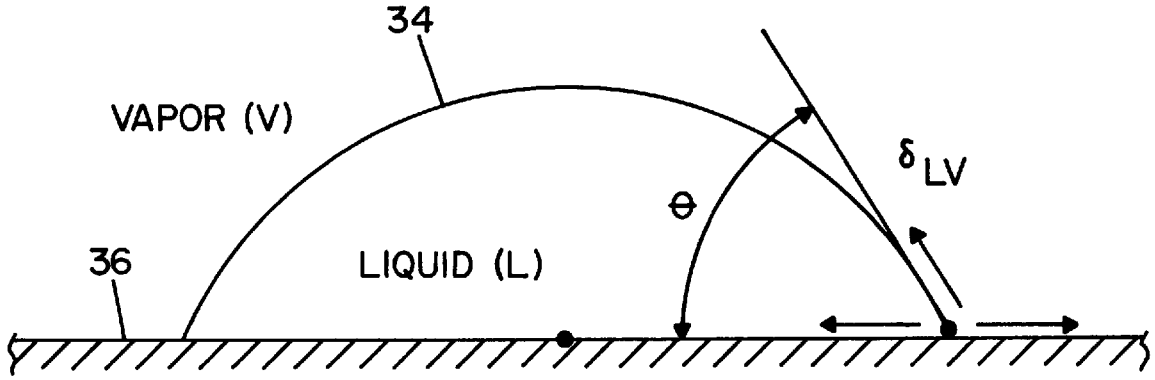
FIG. 5 is a representative drop of liquid on a flat film.

FIG. 2 shows one particular embodiment of a fiber, taken in cross-section and denoted generally by the numeral 30, having a deep grooved configuration in accordance with the present invention. It will be appreciated that the fiber 30 has eight lobes 32 and has at least twice, and more preferably, at least three times, the surface area of a conventional round fiber having the same denier. Moreover, the fiber is capable of spontaneously transporting water on the surface thereof and satisfies either equation $$1-\left(\frac{P_W}{P_{NW}}\right)\cos\theta<0 \quad \text{or} \quad \left(\frac{P_W}{P_{NW}}\right)\cos\theta>1$$

and wherein $P_W$ is the wetted perimeter of the fiber and is defined as twice the height (H in FIG. 3) plus the width (W in FIG. 3), i.e., $P_W$=2H+W; $P_{NW}$ is the non-wetted perimeter of the fiber, or approximately the channel width W; θ is the contact angle of a liquid such as a drop of water 34 measured on a flat film 36 made from the same material as the fiber (see FIG. 5) and having the same surface treatment, if any. When $$\frac{P_W}{P_{NW}}$$

equals the perimeter ratio, then a fiber satisfying the above equation provides spontaneous transportation of water on the surface of the fiber. In order to maximize the spontaneous transportation of the liquid, e.g., water, cos θ must approach 1, meaning that the angle θ must decrease toward zero. In other words, if the contact angle is greater than 90°, then there is no wetting. However, as the contact angle decrease below 90°, wetting begins to occur. Where $\delta_{LV}$ (FIG. 5) is the surface tension of a fluid at its liquid-vapor interface (a constant (≈72 dynes/cm) where, as here, the fluid is always water), and adhesion tension of the fiber equals $\delta_{LV}$ cos θ, it will be appreciated that by decreasing the angle δ, fluid transport will be maximized. For a more detailed description of the deep grooved fibers of the present invention and how they maximize fluid transport, see published PCT application, WO 90/12130, of Eastman Kodak Company, the disclosure of which is incorporated herein by reference. This international application discloses deep grooved fibers, preferably manufactured from polyester. The published application provides that these fibers are capable of spontaneously transporting water and other fluids on their surfaces and that various useful structures or articles can be made from such fibers. However, there is no disclosure or suggestion made relating to the use of these fibers in dewatering press felts, particularly as the batt component thereof.

It will be appreciated that the fibers of the present invention which form the batt are preferably non-woven and preferably made from 100 percent synthetics, preferably, nylon, polyester or polyphenylene sulfide. Most preferably, the fibers are made from a nylon selected from the group consisting of nylon 6, nylon 6,6, nylon 6,10, nylon 6,12, nylon 11, nylon 12, copolymers thereof, and blends thereof. Furthermore, the batt or assembly of fibers preferably contains from about 20 percent to 100 percent fibers having a deep grooved configuration, with 0 to about 80 percent being conventional round fibers. More preferably, the assembly of fibers will contain from about 40 to 100 percent fibers having a deep grooved configuration and from 0 to about 60 percent round fibers. Most preferably, the assembly of fibers will contain at least 50 percent fibers having a deep grooved configuration. Thus, a mixture of round and deep grooved fibers can be utilized.

The fibers having a deep grooved configuration are preferably extruded as is well known in the art using uniquely designed spinnerettes. The spinnerettes have orifices of essentially the same cross-sectional configuration to be provided the fibers. After extrusion and quenching, the fibers may be drawn and/or relaxed through a water bath, heated rollers, and/or an oven. The fibers may then be crimped as is known in the art, preferably in a stufferbox, and typically cured. The fibers may also be drawn through a draw bath and are typically cured in an oven.

In a preferred embodiment, the fibers having a deep groove configuration are coated with a hydrophilic finish. As noted hereinabove, the spontaneous transportation of water or other liquids on the surface of these fibers is maximized as the angle θ decreases. A hydrophilic finish is believed to further aid in the spontaneous transport of liquids.

The hydrophilic finish may be permanent or non permanent. Examples of a permanent hydrophilic finishing composition is available from ICI Surfactants under the tradenames "Milease" and "Raycalube". These hydrophilic copolymers are often used as hydrophilic lubricants. It is believed other permanent finishes are also suitable for this invention. Non permanent hydrophilic finishing compositions include fatty acid esters and ethoxylated derivatives thereof. ICI Surfactants also provides one such suitable fatty acid ester under the trade designation TL1962.

The hydrophilic finish may be applied to the deep-grooved fibers during any of a number of different steps of the production process. For example, the finish may be applied in the draw bath given the fibers. Typically, the fibers are first quenched with air and then drawn and textured. As another alternative, the finish may be applied in the stufferbox during the crimping process. Commonly, the finish is sprayed onto the fibers at the stufferbox and then sent to the oven where the finish is cured with steam or hot air. As yet another alternative, the non-permanent finish may be applied directly to the fibers after they come out of the oven.

Once formed, the fibers are then cut, typically to a length of from about 1 inch to about 6 inches as discussed hereinabove. It will be appreciated that the fibers can be cut to a single length or at multi-lengths, and may be cut variably (i.e., cut to a different length with each cut) or in unison (i.e., cut a single length first, then a second length, and so on).

The assembly of fibers or batt 14 may be produced by any means known in the art. However, typical processing includes blending the fibers together and then carding them into a uniform web. The web of fibers may or may not be preneedled together before it is then applied in a series of layers onto the base fabric 12 to form the batt 14. The web of fibers forming the batt and the base fabric 12 are then fed through a zone where several thousand barbed needles, such as 18, are needle punched into the composite to tack the web or assembly of fibers (i.e., batt) to the base fabric. The assembly of fibers is typically spliced at the start and stop of web application in the cross machine direction. Some processes can apply the web in a spiral method that eliminates cross machine direction oriented splices, however.

Heretofore, the types and deniers of fibers to be used as the web or batt fibers were selected for a number of different reasons. While water handling requirements of the press felt always have been an important consideration in the type of fibers to be used as the web or batt fibers, it was the resultant void volume and compaction or compression of the fiber which dictated the type of fiber employed. A change to the configuration of the fibers used as the batt fibers has never been considered in conjunction with press felts.

Figure 4:
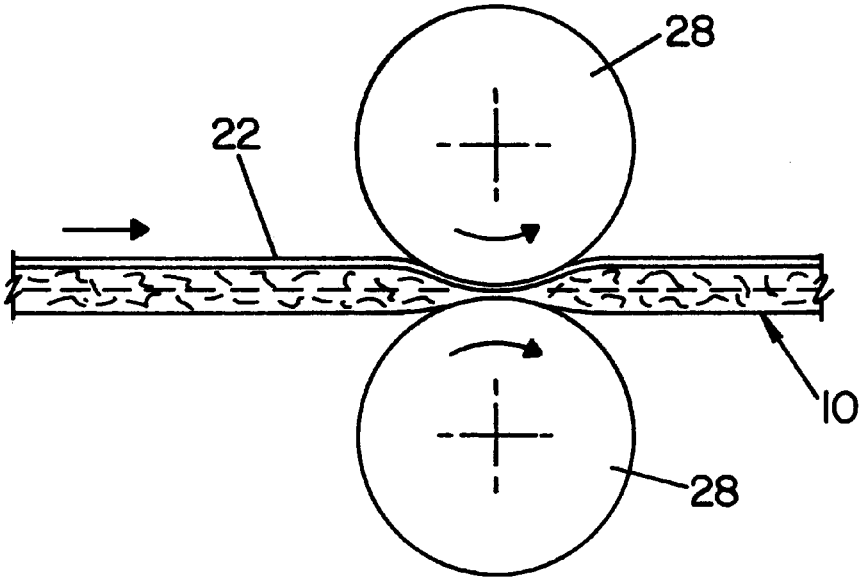
FIG. 4 is a schematic, side elevation view of a press felt embodying the concepts of the present invention transporting a sheet of paper fibers through the press nip rollers within the press section of a papermaking machine.

Once the batt fibers have been needle punched onto the base fabrics, a press felt according to the concepts of the present invention is formed. The press felt can then be disposed within the press section of a papermaking machine as is known in the art and used to dewater sheets of paper fibers. A method for at least partially dewatering or denaturing a sheet of paper fibers within the press section of a papermaking machine begins with the step of positioning the sheet of paper fibers on the press felt of the present invention. As shown in FIG. 4, the sheet of paper fibers 22 essentially rests upon and is supported by the press felt. The sheet is also transported through the press section of the papermaking machine by way of the press felt 10. Typically, the press felt 10 is moved via an automated drive roller (not shown) or the like in much the same way as a conveyor belt. Within the press section, the sheet of paper fibers 22 and the press felt 10 pass through one or more sets of rollers 28 which press the sheet 22 and the press felt 10 to remove the water or other fluid from the sheet 22. Dewatering of the sheet of paper fibers occurs at this press nip via the pressing of the rollers. In some cases where the press rollers also include a suction box, further dewatering may occur via vacuum. In any event, some of the water or fluid will be transported away from the sheet of paper fibers to the press felt 10 via the wicking action of the press felt fibers and the absorption of the water from the sheet of paper fibers to the press felt. That is, water is absorbed into the voids via wicking and absorption. The dewatering of paper sheets is well known to those skilled in the art.

In order to prepare the press felt 10 for further use, a vacuum may be used to dispose of any water left in the voids of the press felt after the paper sheet has passed through the press section of the papermaking machine. Other methods of drying the press felts commonly known in the art may also be employed, i.e., steam boxes.

In order to demonstrate practice of the present invention, samples of two inch by two inch squares of needle punched non-woven fabrics were prepared. Some of the fabrics comprised a plurality of polyester fibers having a deep grooved configuration, while the other fabric squares were made of standard round polyester fibers conventionally utilized as batt in the press section of papermaking machines. A plurality of tests were run for each of these samples, including a sink test, a water pick-up test, and a water removal test.

In the sink test, approximately 600 ml of deionized water was poured into a 2000 ml beaker and the 2×2 inch non-woven square was dropped into the water from the height of the rim of the beaker. The time it took for the fabric to sink was then recorded. Water pick-up was determined by weighing the initial non-woven square and then reweighing the square to determine its saturated weight after the sink test. Water removed was measured by weighing the square after it had been run through the press nip at 25 psi. The results of these tests are shown in Table I hereinbelow.

TABLE I

Test Conducted on 2 × 2 Inch Non-Woven Squares Containing Deep Grooved Fibers and Standard Pet

| Dry Sample @ Start | DG Fiber | Std. PET |
|---|---|---|
| TRIAL 1 | | |
| Initial Wt (g) | .59 | .65 |
| | .59 | .68 |
| Average Wt. (g) | .59 | .67 |
| Time to Sink (sec) | 5.23 | 8.05 |
| | 4.93 | 7.47 |
| Average Time (sec) | 5.08 | 7.76 |
| Water Pick Up (g) | 9.92 | 10.22 |
| | 9.37 | 10.61 |
| Average Wt. Pick Up (g) | 9.65 | 10.42 |
| Wt. After Nip (g) | 1.53 | 1.65 |
| | 1.55 | 1.57 |
| Average Wt. (g) | 1.54 | 1.61 |
| TRIAL 2 | | |
| Initial Wt. (g) | .59 | .64 |
| | .60 | .68 |
| Average Wt. (g) | .60 | .66 |
| Time to Sink (min) | 2.00 | 2.40 |
| | 1.36 | 3.40 |
| Average Time (min) | 1.68 | 2.90 |
| Water Pick Up (g) | 7.70 | 8.88 |
| | 7.46 | 9.67 |
| Average Wt. Pick Up (g) | 7.58 | 9.28 |
| Wt. After Nip (g) | 1.70 | 1.79 |
| | 1.67 | 1.83 |
| Average Wt. (g) | 1.69 | 1.81 |
| TRIAL 3 | | |
| Initial Wt. (g) | 7.17 | 11.09 |
| Time to Sink (min) | 5.01 | 9.30 |
| Average Time (min) | 6.09 | 14.85 |
| Water Pick Up (g) | 8.16 | 8.84 |
| | 7.82 | 9.36 |
| Average Wt. Pick Up (g) | 7.99 | 9.10 |
| Wt. after Nip (g) | 1.63 | 1.75 |
| | 1.56 | 1.83 |
| Average Wt. (g) | 1.60 | 1.79 |

As a result of these tests, it was determined that the square of fibers having the deep groove configuration exhibited significantly faster sink times, on the order of 34 to 59 percent faster, than the square employing the standard polyester fibers. The deep grooved fibers also exhibited significantly larger water pick-up and removal values, compared to the standard polyester fibers.

In addition to the foregoing tests, it was determined necessary to make nylon press felts for comparative dewatering testing. Thus, a pair of press felts comprising a base fabric and a batt needle punched thereto were prepared. The first press felt employed a batt containing a plurality of 15 denier nylon fibers having a deep grooved configuration in accordance with the present invention. The second press felt employed a batt containing conventional, 17 dtex, round nylon fibers currently used in the production of press felts. The nylon is both instances was nylon 6,6.

The press felts were fitted within the press section of a pilot papermaking machine, and paper was run thereon to determine the dewatering characteristics of the press felts. The results of the tests are reported in Table II hereinbelow.

TABLE II

Dewatering Characteristics of Press Felts

| | FELT CONTAINING DG Fiber | FELT CONTAINING Std. PET |
|---|---|---|
| Solids out (%) | | |
| 300 pli | 43.7 | 41.6 |
| Calipers (mils) | | |
| 300 pli | 64.6 | 58.9 |

The difference (2.1%) in the percentage solids remaining after being transported through the press represents a substantial and significant difference in the dewatering characteristics of the felts. Generally, it is believed that the deep grooved configuration of the fibers used in the press felts of the present invention will provide at least a one percent improvement in the dewatering characteristics of the press felts.

Thus, it should be evident that the deep grooved fibers employed as the batt in the press felts of the present invention vastly improved the dewatering characteristics of the felts. It is believed that the fibers allow for improved wicking from within the fibers as well as from the fiber to fiber capillaries. While the uniquely shaped fibers used as at least part of the batt in the press felts of the present invention may be slightly less resistant to needling compared to the round fibers, the fibers can be needle punched as known in the art and provide greater wicking and water removal compared to the round fibers of the prior art.

The fibers of the present invention are particularly suited for use as batt in the press felts, but is not necessarily limited thereto. More example, the fibers are also believed suitable for use in baseless, non-woven press felts. It will also be appreciated that the press felts of the present invention can be manufactured with equipment and methods other than what is detailed hereinabove, it being understood that the equipment and methods for producing the press felts, base fabrics and batt, as well as other materials, has been provided for purposes of illustration and demonstration only. That is, the description and illustration of the present invention shown hereinabove is byway of example, and the scope of the invention is not limited to the exact details shown or described.

Having now described the features, discoveries and principles of the invention, the manner in which the improved press felt is constructed and used, the characteristics of the construction, and the advantageous, new and useful results obtained; the new and useful press felts should be understood and are set forth in the appended claims.

Based upon the foregoing disclosure, it should now be apparent that the use of the press fabrics described herein will carry out the objects set forth hereinabove. It is, therefore, to be understood that any variations evident fall within the scope of the claimed invention and thus, the selection of specific types of and materials for the fibers, monofilaments, yarns or the like and the methods for the production thereof can be determined without departing from the spirit of the invention herein disclosed and described. Thus, the scope of the invention shall include all modifications and variations that may fall within the scope of the attached claims.

What is claimed is:

1. A press felt for transporting and dewatering a sheet of paper fibers in the press section of a papermaking machine comprising:

a base fabric; and at least one layer of an assembly of fibers securely attached to said base fabric, said assembly of fibers including a plurality of fibers each having a grooved configuration of variable channel depth and having a surface area greater than twice as large as a surface area of a round fiber of the same denier.

2. The press felt according to claim 1, wherein said base fabric is woven from at least one of cabled monofilament, plied multifilaments, spun yarns, or single monofilaments.

3. The press felt according to claim 1, wherein said base fabric is a single layer or a multilayer mesh.

4. The press felt according to claim 1, wherein said base fabric has a first side directed toward the sheet of paper fibers and a second side directed toward the machine, and wherein said at least one layer of said assembly of fibers is needle punched onto said base fabric on said first side.

5. The press felt according to claim 1, wherein said base fabric is a scrim.

6. The press felt according to claim 1, wherein said base fabric is a composite structure.

7. The press felt according to claim 1, wherein said assembly of fibers contains from about 20 percent to 100 percent of said fibers having a grooved configuration and from about 0 to about 80 percent of fibers having a round configuration.

8. The press felt according to claim 7, wherein said assembly of fibers contains from about 40 percent to 100 percent of said fibers having a grooved configuration and from about 0 to about 60 percent of fibers having a round configuration.

9. The press felt according to claim 1, wherein said fibers having a grooved configuration are made of a material selected from the group consisting of nylon, polyester, and polyphenylene sulfide.

10. The press felt according to claim 9, wherein said fibers are made of nylon.

11. The press felt according to claim 10, wherein said fibers are made of nylon 6, nylon 6,6, nylon 6,10, nylon 6,12, nylon 11, nylon 12, copolymers thereof, and blends thereof.

12. The press felt according to claim 1, wherein each of said plurality of fibers having a grooved configuration has at least five lobes.

13. The press felt according to claim 12, wherein each of said plurality of fibers having a grooved configuration has at least eight lobes.

14. The press felt according to claim 1, wherein each of said fibers having a grooved configuration has a length of from about 1 inch to about 6 inches.

15. The press felt according to claim 14, wherein each of said fibers having a grooved configuration has a length of from about 3.0 inches to about 4 inches.

16. The press felt according to claim 1, wherein said fibers range from about 3 denier to about 50 denier.

17. The press felt according to claim 16, wherein said fibers range from about 15 denier to about 25 denier.

18. The press felt according to claim 1, wherein each of said fibers having a grooved configuration is configured such that the width of a groove at any depth in not greater than the width of the groove at the mouth of the groove.

19. The press felt according to claim 1, wherein said fibers having a grooved configuration include a hydrophilic finish.

20. The press felt according to claim 19, wherein said hydrophilic finish is permanent.

21. The press felt according to claim 19, wherein said hydrophilic finish is non-permanent and is a fatty acid ester.

22. The press felt according to claim 1, wherein the fibers having a grooved configuration are each capable of spontaneously transporting water on the surface thereof and satisfies the equation $$1-\left(\frac{P_W}{P_{NW}}\right)\cos\theta<0$$

wherein Pw is a wetted perimeter of the fiber defined as twice a height of a groove plus a width of the groove; PNW is a non-wetted perimeter of the fiber; θ is a contact angle of a liquid measured on a flat film made from a same material as the fiber; and PW/PNW equals a perimeter ratio.

23. A method for at least partially dewatering a sheet of paper fibers within the press section of a papermaking machine comprising:

positioning the sheet of paper fibers on a press felt including a base fabric and at least one layer of an assembly of fibers securely attached to the base fabric, the assembly of fibers including a plurality of fibers each having a grooved configuration of variable channel depth and having a surface area greater than twice as large as a surface area of a round fiber of the same denier;

transporting the sheet through the press section; and pressing the sheet to remove water from the sheet.

24. The method according to claim 23, wherein said assembly of fibers contains from about 20 percent to 100 percent of said fibers having a grooved configuration and from about 0 to about 80 percent of fibers having a round configuration.

25. The method according to claim 24, wherein said assembly of fibers contains from about 40 percent to 100 percent of said fibers having a grooved configuration and from about 0 to about 60 percent of fibers having a round configuration.

26. The method according to claim 23, wherein said fibers having a grooved configuration are made of a material selected from the group consisting of nylon, polyester, and polyphenylene sulfide.

27. The method according to claim 23, wherein each of said plurality of fibers having a grooved configuration has at least five lobes.

28. The method according to claim 23, wherein each of said fibers having a grooved configuration has a length of from about 1 inch to about 6 inches.

29. The method according to claim 23, further comprising the steps of transporting the water away from the sheet; and releasing the water from the press felt.

* * * * *